US009241863B2

(12) United States Patent
Dhanai

(10) Patent No.: US 9,241,863 B2
(45) Date of Patent: Jan. 26, 2016

(54) ANKLE EXERCISER

(76) Inventor: Neville Dhanraj Dhanai, Brampton (CA)

( * ) Notice: Subject to any disclaimer, the term of this patent is extended or adjusted under 35 U.S.C. 154(b) by 527 days.

(21) Appl. No.: 13/597,849

(22) Filed: Aug. 29, 2012

(65) Prior Publication Data

US 2013/0053224 A1 Feb. 28, 2013

Related U.S. Application Data

(60) Provisional application No. 61/528,420, filed on Aug. 29, 2011.

(51) Int. Cl.

| | |
|---|---|
| ***A63B 23/08*** | (2006.01) |
| ***A61H 1/02*** | (2006.01) |
| ***A61H 23/02*** | (2006.01) |

(52) U.S. Cl.

CPC ..... *A61H 1/0266* (2013.01); *A61H 23/0263* (2013.01); *A63B 23/08* (2013.01); *A63B 23/085* (2013.01); *A61H 2201/1215* (2013.01); *A61H 2201/1246* (2013.01); *A61H 2201/149* (2013.01); *A61H 2201/1676* (2013.01); *A61H 2209/00* (2013.01)

(58) Field of Classification Search

CPC ..... A61H 1/0266; A61H 23/0263; A61H 2201/149; A61H 2201/1246; A61H 2201/1215; A61H 2201/1676; A61H 2209/00; A63B 21/00178; A63B 23/08; A63B 23/085; A63B 23/10

USPC ..... 482/51–53, 79, 80, 146, 147; 601/27–32

See application file for complete search history.

(56) References Cited

U.S. PATENT DOCUMENTS

| | | | | |
|---|---|---|---|---|
| 2,924,214 | A * | 2/1960 | Zak | 601/29 |
| 4,159,111 | A * | 6/1979 | Lowth | 482/80 |
| 4,306,714 | A * | 12/1981 | Loomis et al. | 482/79 |
| 4,862,875 | A * | 9/1989 | Heaton | 601/26 |
| 5,474,520 | A * | 12/1995 | Bittikofer | 601/27 |
| 6,572,514 | B1 * | 6/2003 | Calafato | 482/79 |
| 6,749,539 | B2 * | 6/2004 | Hsieh | 482/51 |
| 7,008,357 | B2 * | 3/2006 | Winkler | 482/142 |
| 7,335,172 | B2 * | 2/2008 | Laserow | 601/30 |
| 7,485,073 | B2 * | 2/2009 | Chang | 482/70 |
| 8,550,963 | B1 * | 10/2013 | Bradford et al. | 482/79 |
| 2004/0053753 | A1 * | 3/2004 | Campos | 482/70 |
| 2010/0010397 | A1 * | 1/2010 | Ochi et al. | 601/27 |
| 2010/0075813 | A1 * | 3/2010 | Ochi et al. | 482/79 |
| 2011/0021316 | A1 * | 1/2011 | Saitou et al. | 482/4 |
| 2012/0296242 | A1 * | 11/2012 | Ochi et al. | 601/5 |

FOREIGN PATENT DOCUMENTS

CH 6820495 A5 * 7/1993

* cited by examiner

*Primary Examiner* — Loan H Thanh
*Assistant Examiner* — Gregory Winter
(74) *Attorney, Agent, or Firm* — Head, Johnson & Kachigian, P.C.

(57) ABSTRACT

An ankle exerciser system for providing automated flexing of an ankle of a user. The system may include a first support, a first pivot for permitting movement of the first support about a transverse axis, a second support, a second pivot for permitting movement of the second support about the transverse axis, and a drive element operatively coupled to pivot the first support and operatively coupled to pivot the second support about the transverse axis. The first support and the second support may be controlled to incline and decline to and from a specified angle of rotation. The inline and decline may be performed at a specified frequency for a specified duration. A vibrator may further be used to vibrate the supports, to vibrate one or both of the feet supported thereon.

7 Claims, 6 Drawing Sheets

ANKLE EXERCISER

CROSS-REFERENCE TO RELATED APPLICATIONS

This application claims priority to U.S. Provisional Application No. 61/528,420, filed Aug. 29, 2011, and Canadian Patent Application No. 2,773,449, filed Apr. 2, 2012, which are herein incorporated by reference.

BACKGROUND OF THE INVENTION

1. Field of the Invention

Example embodiments relate generally to exerciser systems, and in particular to exerciser systems for facilitating ankle flexing.

2. Prior Art

In some existing exerciser systems, a driving element may be used to operate the system to facilitate and repeat a particular range of motion for the user. In such systems, the driving element may not be properly configured to provide increased strength or load balancing to support to the system.

For example, some conventional systems may have the driving element being coaxial with a pivoting member. Such a system may not provide sufficient leverage to simulate the particular range of motion for a particular user's bone joint which may be coaxial with the pivoting member.

In another example, some conventional exerciser systems are designed for use with a single limb such as one leg or foot. In such systems, the support and load balancing may be optimally designed for use with only the single limb.

In yet some further existing systems, merely an ankle strap is used to secure a leg or foot to the system. This may not provide the desired security as separation may occur between the foot and the device, especially at higher frequencies.

Additional difficulties with existing systems may be appreciated in view of the description below.

SUMMARY OF THE INVENTION

In accordance with an example embodiment, there is provided an exerciser system, including: a first support having a transverse plane, a first pivot for permitting movement of the first support about a transverse axis, a connector operatively connected to the first support including at least a portion of the connector extending transversely past the first support, and a drive element operatively coupled to the at least a portion of the connector at a part of the connector away from the transverse axis for moving of the connector to pivot the first support about the first pivot.

In accordance with another example embodiment, there is provided a method for operating an exercise system, including: moving a first support having a transverse plane about a transverse axis in an axial rotation, wherein a connector is operatively connected to the first support including at least a portion of the connector extending transversely past the first support; and driving the at least a portion of the connector at a part of the connector away from the transverse axis for said moving of the connector.

In accordance with yet another example embodiment, there is provided an exerciser system, including: a first support; a first pivot for permitting movement of the first support about a transverse axis; a second support; a second pivot for permitting movement of the second support about the transverse axis; and a drive element operatively coupled to pivot the first support and operatively coupled to pivot the second support about the transverse axis.

BRIEF DESCRIPTION OF THE DRAWINGS

Embodiments will now be described by way of example with reference to the accompanying drawings, in which like reference numerals are used to indicate similar features, and in which.

DETAILED DESCRIPTION OF THE PREFERRED EMBODIMENT

In accordance with an example embodiment, there is provided an exerciser system, including: a first support having a transverse plane, a first pivot for permitting movement of the first support about a transverse axis, a connector operatively connected to the first support including at least a portion of the connector extending transversely past the first support, and a drive element operatively coupled to the at least a portion of the connector at a part of the connector away from the transverse axis for moving of the connector to pivot the first support about the first pivot.

In accordance with another example embodiment, there is provided a method for operating an exercise system, including: moving a first support having a transverse plane about a transverse axis in an axial rotation, wherein a connector is operatively connected to the first support including at least a portion of the connector extending transversely past the first support; and driving the at least a portion of the connector at a part of the connector away from the transverse axis for said moving of the connector.

In accordance with yet another example embodiment, there is provided an exerciser system, including: a first support; a first pivot for permitting movement of the first support about a transverse axis; a second support; a second pivot for permitting movement of the second support about the transverse axis; and a drive element operatively coupled to pivot the first support and operatively coupled to pivot the second support about the transverse axis.

Some example embodiments generally provide an automated exerciser system for the foot, ankle and/or leg. The system may be placed on a floor having supports to receive the feet of a user sitting on a chair to give an automated exercising motion to the feet, the ankle and/or the leg.

In some example embodiments, the exerciser system may include an incline and a decline motion with the specified level of degree being settable by the user. The incline and decline motion simulates generally understood therapeutic exercises that can assist to increase an ankle dorsiflexion/plantarflexion and to strengthen the muscles in the shin and the calf. The exerciser system may assist in mobilization, blood flow and relief to foot injuries.

Accordingly, reference may be may to "lifting" or "raising", or "lowering", which references a vertical movement with respect to that starting position of the exerciser system being placed on the floor at a generally horizontal starting position.

In some example embodiments, a vibrator may further be used at vibrate parts of the exerciser system, to vibrate the feet supported thereon.

Figure 5:
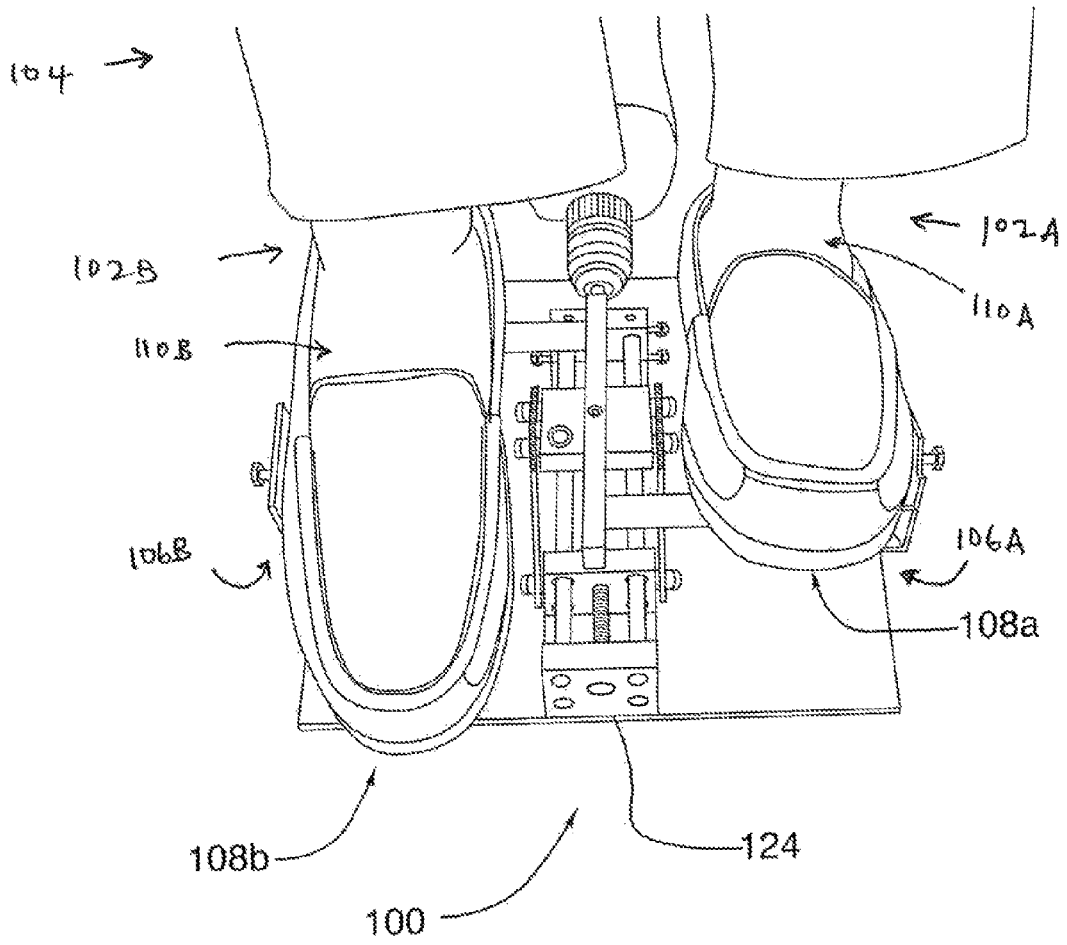
FIG. 5 shows a perspective view of the ankle exerciser system shown in FIG. 1 in operation.

Reference is first made to FIG. 5, which generally illustrates an ankle exerciser system 100 for automated exercising of at least one of the left ankle 102*a* or the right ankle 102*b* of a user 104, in accordance with an example embodiment. The example exerciser system 100 shown includes a left foot support 106*a* shown as a left shoe plate and a right foot support 106*b* shown as a right shoe plate. Generally, in example embodiments the left foot support 106*a* and the right foot support 106*b* may be automated to create a repeating incline and decline motion to a specified angle.

As shown in FIG. 5, the left foot support 106*a* is configured for supporting of a left shoe member 108*a*; and the right foot support 106*b* is configured for supporting of a right shoe member 1081). As shown, the left shoe member 108*a* may receive a left foot 110*a* of the user 104 and the right shoe member 108 may receive a right foot 110*b* of the user 104. The incline and decline motion may generally assist in dorsiflexion and plantarflexion of the ankles 102*a*, 102*b* and to strengthen the muscles in the shin and the calf of the user 104. The exerciser system 100 may, for example, assist in mobilization, blood flow and relief to foot injuries. The incline and decline motion may be repeated at a specified frequency for a specified duration.

Reference is now made to FIGS. 1 to 4, which show the exerciser system 100 in greater detail. The exerciser system 100 shown is configured to provide alternating pivoting of the left foot support 106*a* and the right foot support 106*b*. In other words, when the left foot support 106*a* is automated to incline, the right support 106*b* may be automated to decline. Similarly, when the left foot support 106*a* is automated to decline, the right support 106*b* is automated to incline. A base 124 may also be used as a support structure for mounting of at least some or all of the components of the exerciser 100. The base 124 may be formed of a rigid material such as a metal plate, as shown.

Figure 2:
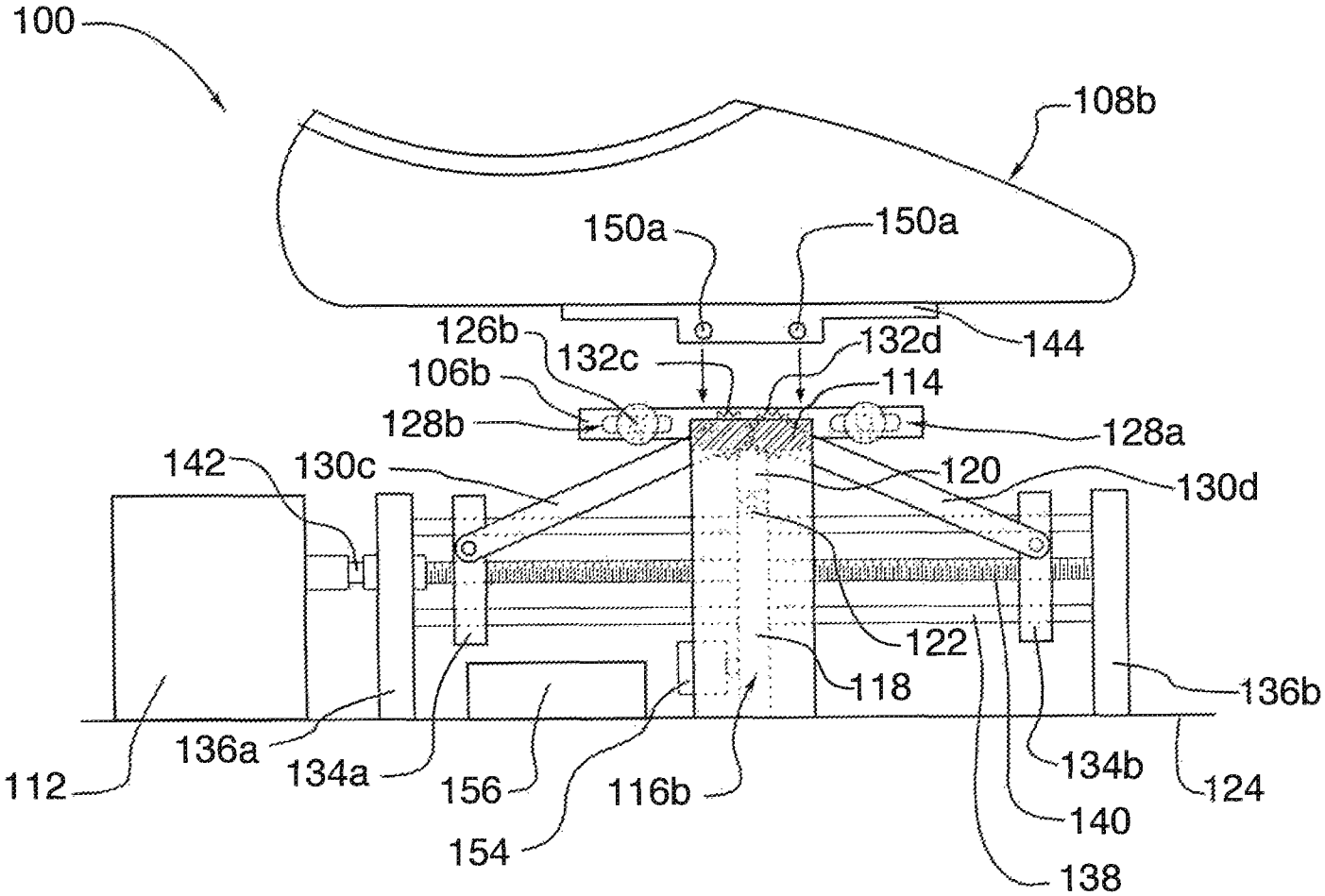
FIG. 2 shows a right side detail of the ankle exerciser system shown in FIG. 1.
Figure 4:
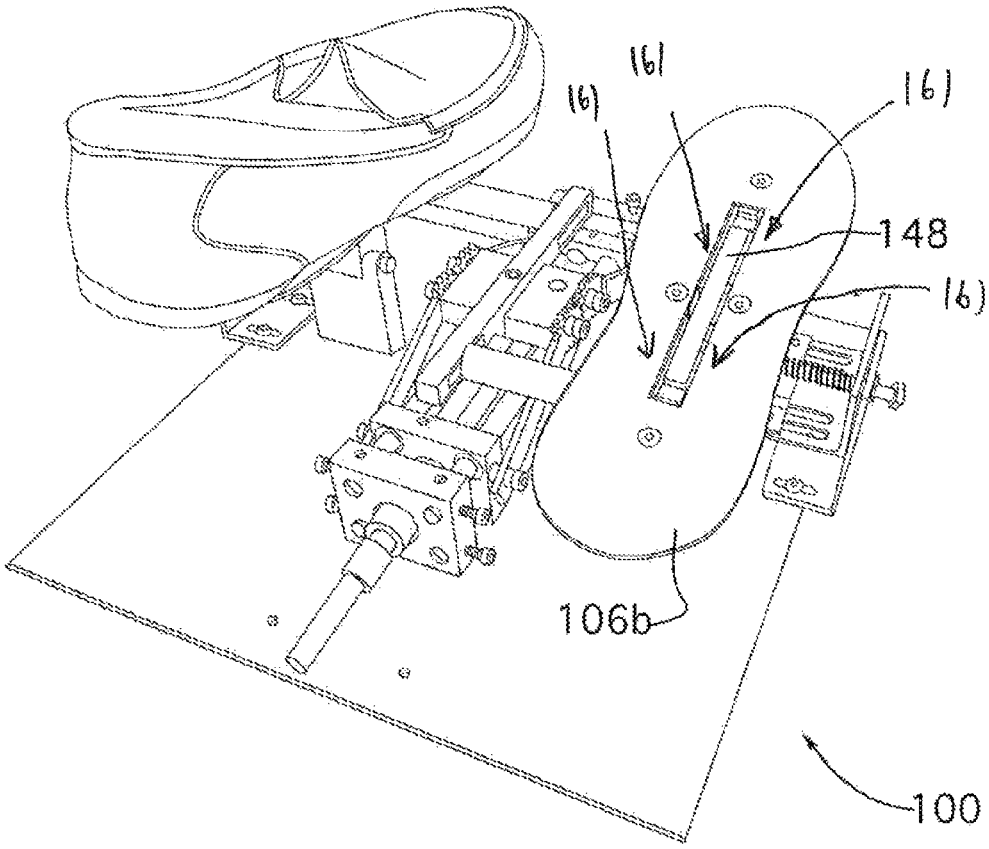
FIG. 4 shows a perspective view of the ankle exerciser system shown in FIG. 1 having a right shoe member detached.

Reference is now made to FIG. 2, which shows the pivoting aspect associated with the right foot support 106*b* [not shown] in greater detail, to provide the incline and decline motion. This pivot for the right foot support 106*b* may be provided by right swivel plate 116*b*, which is shown as being generally vertically oriented. The swivel plate 116*b* may include a lower plate 118 and an upper plate 120 which may each include a male part or a corresponding female part for connection there between. The lower plate 118 and the upper plate 120 are connected by a hinged connection such as a shoulder bolt 122. Accordingly, in some example embodiments a stable pivoting motion may occur at the shoulder bolt 122 about a transverse axis as defined by the shoulder bolt 122. Thus, reference may be made to a transverse plane of the right foot support 106*b*, and the transverse axis may be within or parallel to the transverse plane. The upper plate 120 may be secured to the right foot support 106*b* (e.g. using four screws, as indicated by FIG. 4) while the lower plate 118 may be connected to the base 124 of the exerciser system 100.

A similar configuration would apply to the left foot support 106*a*. For example, referring to FIG. 1, a similar configuration may be used for a left swivel plate 116*a* for pivoting of the left foot support 106*a*. In some example embodiments, the left swivel plate 116*a* also includes a shoulder bolt (not labeled) which provides for pivoting about a same transverse axis as the shoulder bolt 122 of the right swivel plate 116*b*.

Figure 3:
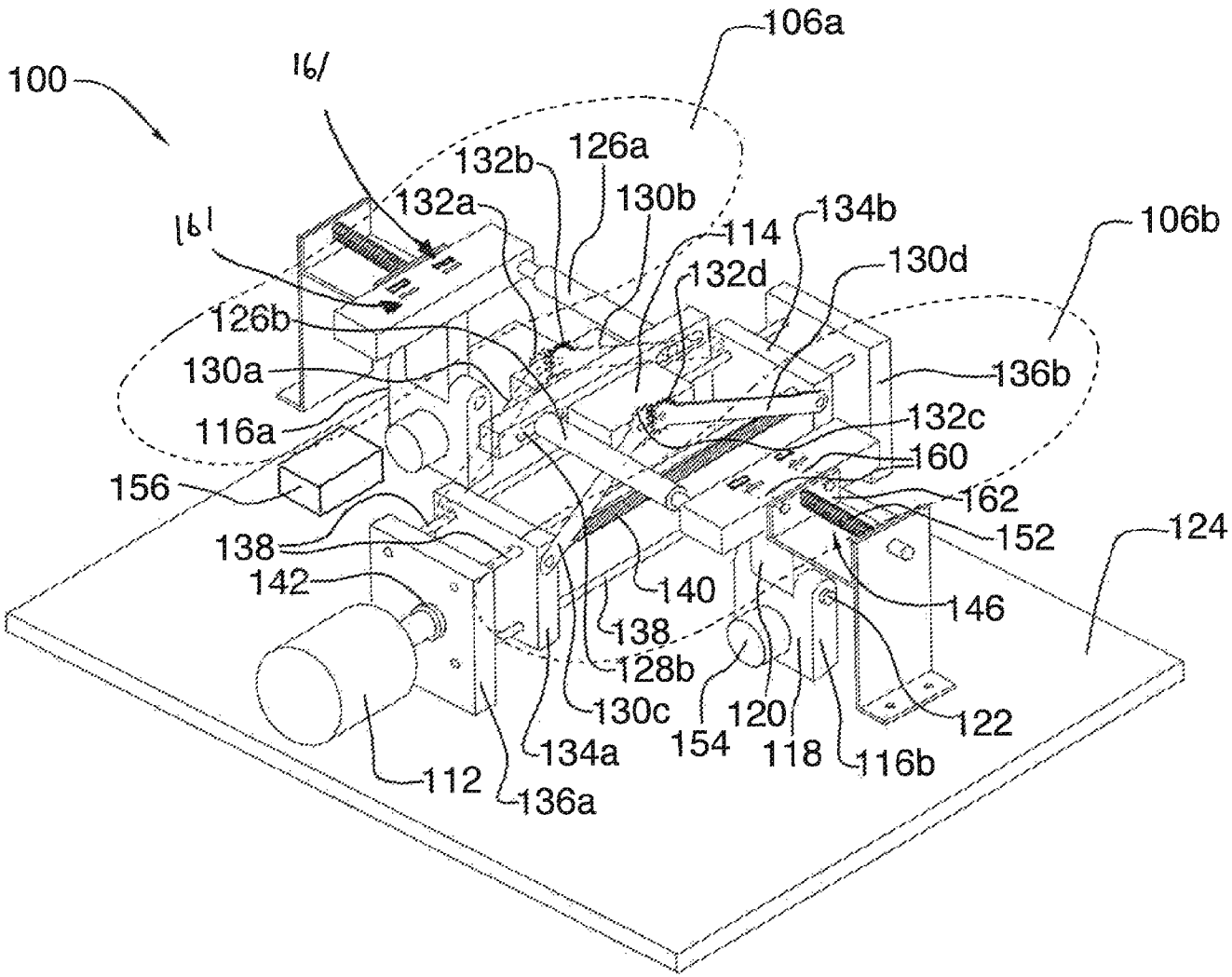
FIG. 3 shows a perspective view of the ankle exerciser system shown in FIG. 1.

Referring now to FIG. 3, the automated control of the pivoting of the foot supports 106*a*, 106*b* will now be described in greater detail. A drive element such as a motor 112 may be operatively coupled to control operation of the left foot support 106*a* and the right foot support 106*b*. As shown in FIG. 3, a right connector 126*b* may have one end secured to the right swivel plate 116*b*, for example at the upper plate 120. At the distal end of the right connector 126*b*, at least a portion of the right connector 126*b* extends transversely past the swivel plate 116*b* (transversely meaning same or parallel to the transverse plane). The distal end of the right connector 126*b* slideably connects to a central body member such as a lifter plate 114. As best shown in FIG. 2, for example, the lifter plate 114 defines a right channel 128*b* for receiving a shoulder bolt (not labeled) from the right connector 126*b*, to provide the slideable connection.

The motor 112 may be operatively coupled to control raising or lowering of the lifter plate 114. For example, referring to the view shown in FIG. 2, upon raising of the lifter plate 114, the distal end of the right connector 126*b* would correspondingly lift and slide rightwardly along the right channel 128*b*. Due to the leverage provided by moving the distal end of the right connector 126*b*, the right foot support 106*b* would thereby axially rotate clockwise about the shoulder bolt 122. Still referring to the view shown in FIG. 2, upon lowering of the lifter plate 114, the distal end of the right connector 126*b* would correspondingly lower and slide leftwardly along the right channel 128*b*, thereby causing counter-clockwise axial rotation of the right foot support 106*b*.

Referring to FIG. 3, a left connector 126*a* is configured in a similar fashion as the right connector 126*b*. The left connector 126*a* has one end secured to the left foot support 106*a* and includes a transversely extending distal end which is slideably connected to an opposing face of the lifter plate 114. The slideable connection may include a shoulder bolt (not labeled) engaging a left channel 128*a* (FIG. 2) defined by the lifter plate 114. The left connector 126*a* operates in a similar fashion to the right connector 126*b*. From the view of FIG. 2, upon raising of the lifter plate 114, the left foot support 106*a* (not shown here) axially rotates counter-clockwise about the transverse axis. Upon lowering of the lifter plate 114, the left foot support 106*a* axially rotates clockwise about the transverse axis.

As shown in FIG. 3, in some example embodiments, the lifter plate 114 may be centrally located between the left foot support 106*a* and the right foot support 106*b*. In the example embodiment shown, the slideable connections of the left connector 126*a* and the right connector 126*b* are positioned equally and oppositely from a central region of the lifter plate 114. Accordingly, a single movement of raising or lowering the lifter plate 114 may result in equal and opposite pivoting of the left foot support 106*a* and the right foot support 106*b*. The lifter plate 114 is operatively coupled to be driven by the motor 112 and may act as a central drive point for the motor 112 between the left foot support 106*a* and the right foot support 106*b*. In some example embodiments, it may be appreciated that the central configuration of the lifter plate 114 may assist in providing leverage to pivot the left foot support 106*a* and the right foot support 106*b*, and may assist in load balancing there between. For example, in some example embodiments, only the single motor 112 may be required to provide a single driving force to operatively control both of the left foot support 106*a* and the right foot support 106*b*.

Referring still to FIG. 3, the configuration for raising or lowering of the lifter plate 114 will be described in greater detail. At the central region on one face of the lifter plate 114, there is pivotally mounted a first arm 130*a* and a second arm 130*b*. On an opposing face of the lifter plate 114, there is pivot mounted a third arm 130*c* and a fourth arm 130*d*. The arms 130*a*-130*d* may act in unison to uniformly raise or lower the lifter plate 114.

Figure 1:
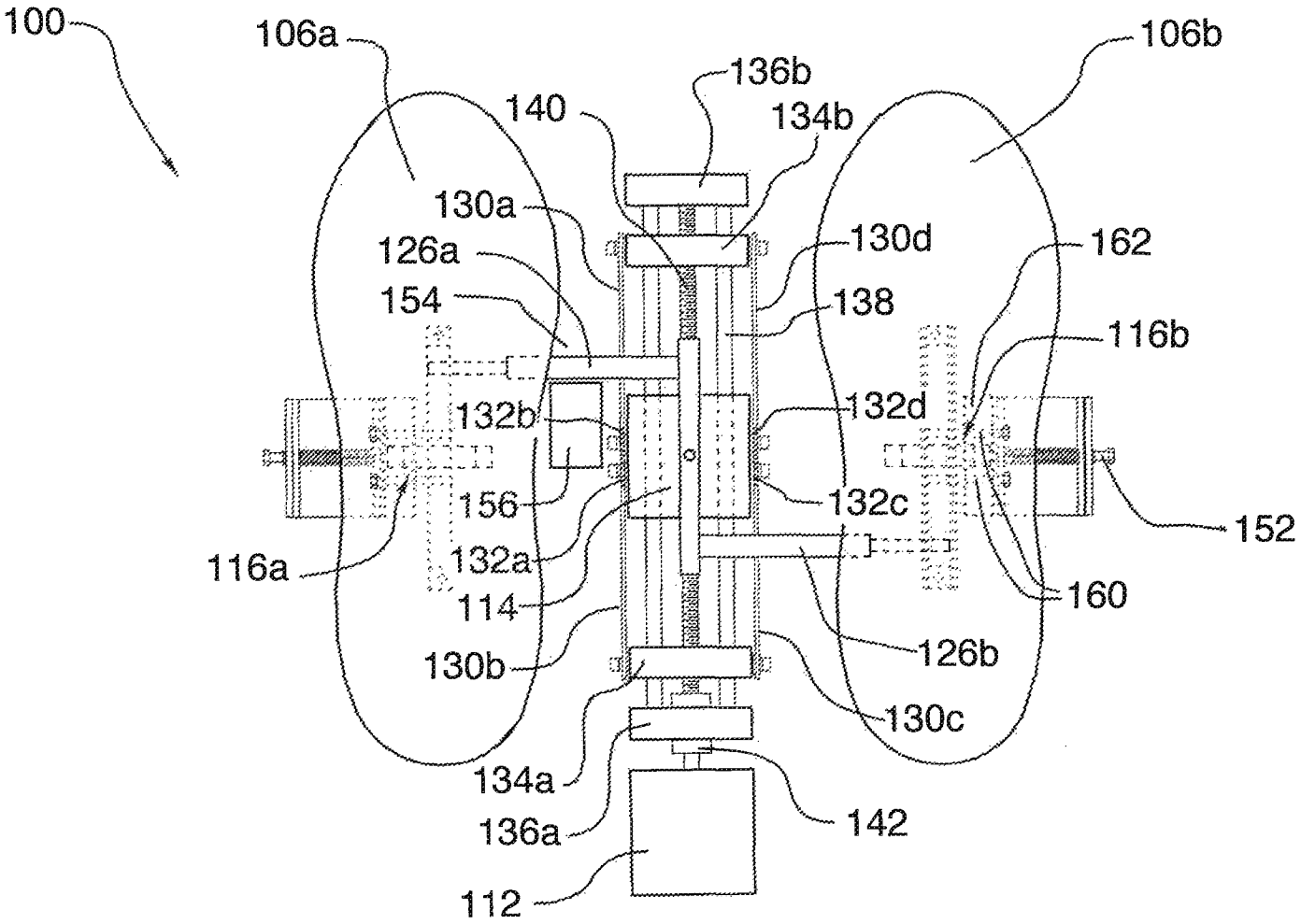
FIG. 1 shows a top detail of an ankle exerciser system in accordance with an example embodiment.

As best shown in FIG. 1, each of the gears 132*a-d* includes a shoulder bolt (not labeled) for pivot mounting of the respective arms 130*a-d* to the lifter plate 114. The first gear 132*a* and the second gear 132*b* are interlocked and meshed together for facilitating equal and opposite pivoting of the first arm 130*a* and the second arm 130*b*. Similarly, the third gear 132*c* and the fourth gear 132*d* are interlocked and meshed together for facilitating equal and opposite pivoting of the third arm 130*c* and the fourth arm 130*d*. Each of the gears 132*a-d* include a bronze bushing (not labeled) inserted in the centre of each gear 132*a-d* and secured with the shoulder bolts (not labeled) to the lifter plate 114. The bushings may facilitate a smooth operation and longevity to the system 100 to prevent any seizing. Accordingly, horizontal movement of the distal ends of the arms 130*a-d* can result in raising or lowering of the lifter plate 114, for example using the motor 112.

Referring again to FIG. 3, a first carriage such as first moving block 134*a* and a second carriage such as second moving block 134*b* may be used to effect horizontal movement of the distal ends of the arms 130*a-d*. Each distal end of the arms 130*a-d* may include bronze bushings inserted in them and can be pivot mounted to the moving blocks 134*a*, 134*b*. As shown, first arm 130*a* and third arm 130*c* are pivot mounted to opposing regions of the first moving block 134*a*, and second arm 130*b* and fourth arm 130*d* are pivotally mounted to opposing regions of the second moving block 134*d*.

Referring still to FIG. 3, a first hold down block 136*a* and a second hold down block 136*b* may be fixedly mounted to the base 124 (FIG. 2). The hold down blocks 136*a*, 136*b* may be formed of suitable rigid material such as aluminum. Each of the hold down blocks 136*a*, 136*b* may define a plurality of holes (e.g., four holes, as shown) each which are drilled and reamed to accommodate guide shafts, shown as four harden guide pins 138. There may also be included bearings (not labeled) which are located in the centre of the four guide pins 138. The four guide pins 138 may be anchored with set screws (not labeled) on the side of the hold down blocks 136*a*, 136*b*.

Each of the moving blocks 134*a*, 134*b* may define a plurality of holes (e.g., four holes, as shown) each which are drilled and reamed to mount to the guide pins 138. Accordingly, the guide pins 138 may provide a track or specified path for horizontal movement of the moving blocks 134*a*, 134*b*. The guide pins 138 may absorb the tension from the two moving blocks 134*a*, 134*b* when moving, permitting smooth operation and horizontal movement.

A worm gear screw shown as lead screw 140 is for mounting of the moving blocks 134*a*, 134*b* for horizontal movement along the guide pins 138. The lead screw 140 is accommodated at one end by the first hold down block 136*a*, and passes through the first hold down block 136*a* for operative coupling to the motor 112. The bearings (not labeled) that are located in the hold down blocks 136*a*, 136*b* may enable a smooth rotation of the lead screw 140.

In some example embodiments, the lead screw 140 includes a left hand thread region and a right hand thread region. The left hand thread region may be located at the first moving block 134*a* and can engage through a left hand bronze nut on the moving block 134*a* and continues into the bearing (not labeled) of the first hold down block 136*a*. The right hand thread region may be located at the second moving block 134*b* and can engage through a right hand bronze nut on the second moving block 134*b* and continues into the bearing (not labeled) of the second hold down block 136*b*. Accordingly, a single turning of the lead screw 140 results in equal and opposite horizontal movement of the first moving block 134*a* and the second moving block 134*b*.

The lead screw 140 may be driven or rotated by the motor 112. Referring still to FIG. 3, a drive pin 142 may be provided wherein one end of the drive pin 142 is connected to the lead screw 140 for turning of the lead screw 140 and the other end of the drive pin 142 is connected to the motor 112 via a clamp (not labeled). The end of the drive pin 142 may go through the first hold down block 136*a* and may be adjusted by a lock nut (not labeled) to absorb the tension on the lead screw 140 and ensure accurate delivery of the required drive.

Referring still to FIG. 3, a mechanism for releasably attaching the shoe members 108*a*, 108*b* to the foot supports 106*a*, 106*b* will now be described in greater detail. The right shoe member 108*b* may be releasably attached to the right foot support 106*b*. As shown in FIG. 2, a right shoe hold down device 144 can be included or installed at a base of the shoe member 108*b*. In some example embodiments, the right shoe hold down device 144 can be releasably connected to the upper plate 120 of the swivel plate 116*b*. The right shoe hold down device 144 at the base may also define a longitudinal slot 158, shown in FIG. 7. Referring briefly to FIG. 4, the longitudinal slot may be used for slotting the right shoe hold down device 144 onto a ridge 148 of the right foot support 106*b*. The slotting of the shoe mechanism may facilitate safety, security and stability of the shoe member 108*b*.

Figure 7:
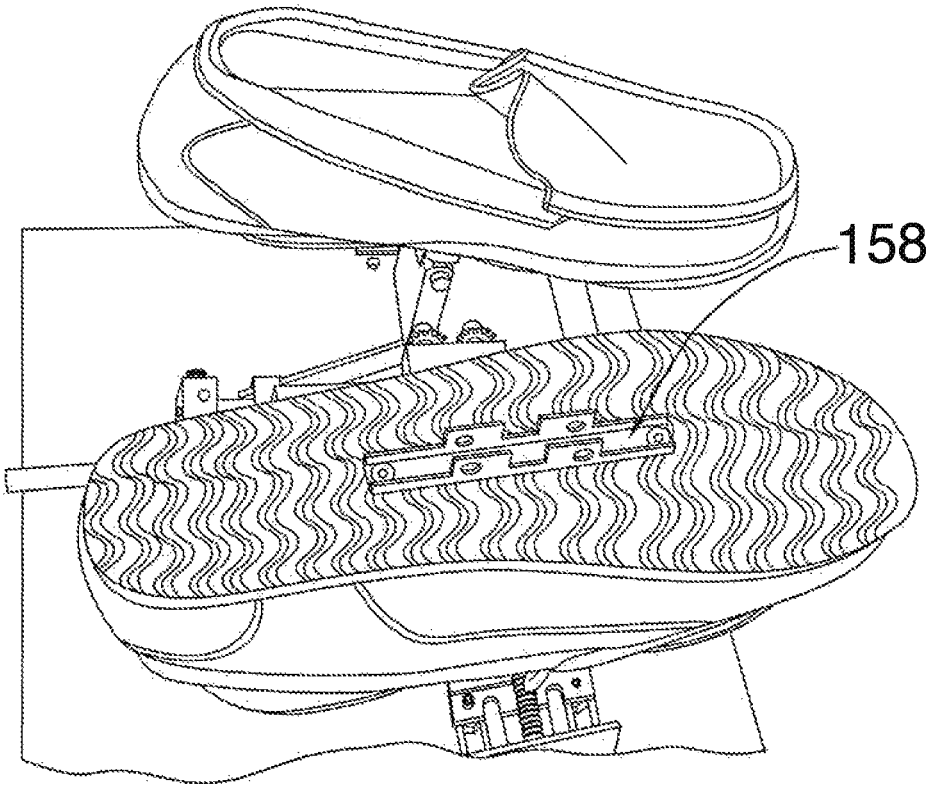
FIG. 7 shows a view of the ankle exerciser system, with the right shoe member disconnected and upended.

As shown in FIG. 7, the right shoe hold down device 144 may include at least two transverse apertures 150*a*, 150*b* located in tabs. The tabs can be disposed within slots 161. As shown in FIG. 3, a release mechanism 146 may include two locating pins 160 and a spring loaded release pin 152 on a sliding mechanism. The two locating pins 160 may be connected to a movement control block 162. When the tabs are located in slots 161, the locating pins 160, for attachment, may traverse through the two transverse apertures 150*a*, 150*b* of the right shoe hold down device 144 and through an alignment block (not labeled). This operation may be used to secure the shoe member 108*b* in a locked position. When required to change the shoe member 108*b*, the user 104 may pull back on the spring loaded release pin 152 to retreat the two locating pins 160 from the two transverse apertures 150*a*, 150*b*, and thereafter lift the shoe member 108*b* off of the foot support 106*b*.

The shoe member 108*a*, 108*b* may include various shoe types or sandal types, which may include velcro straps and may include a shell formed of a soft and/or comfortable material. The shoe member 108*a*, 108*b* may include varying sizes and colours to accommodate personal need. Individual shoes may be used and customized for each user, for example for hygienic reasons.

Referring now to FIG. 2, at least one vibrator 154 may further be used to vibrate the foot supports 106*a*, 106*b* to vibrate one or both of the feet 110*a*, 110*b* supported thereon. The vibrator 154 may be controlled by a separate vibrating motor (not labeled) from the main motor 112. The vibrator 154 may include an offset rubber mechanism (not labeled) which is connected to a shaft of the vibrating motor. When the vibrating motor is powered, the offset rubber mechanism is controlled to drum in a controlled continuous motion, which creates a vibrating action. The time and intensity of the vibration may be individually controlled as desired.

In some other example embodiments, the vibrator 154 may be located in other locations on the exerciser system 100. For example, these locations may include the swivel plate 116*a*,

116*b*, a bottom of the foot supports 106*a*, 106*b*, the base plate 125, and/or the shoe hold down device 144 of the shoe members 108*a*, 108*b*.

Example operations of the exerciser system 100 may be programmed or controlled using a controller 156 such as a microcontroller. The controller 156 may be used to control the specified degree, cycle time, the pause cycle, and the exercise time by controlling the motor 112. The controller 156 may also control the vibration time and intensity of the vibrator 154. The controller 156 may be controlled using a hand held remote control (not shown).

This movement may be set to a specified degree, for example varying from 0 to 30 degrees. The specified degree may be controlled by controlling the number of rotations of the lead screw 140, for example. The movement may be set to a speed rate of for example, up to 10000 R.P.M. There may also be a pause cycle time in between the incline and decline movement, for example of up to 30 seconds, which may allow the feet 110*a*, 110*b* to hold the pressure for the amount of time desired by the user 104. The timing of the exercise may be set up to specified time period, for example 30 minutes. The variable degree, the pause cycle, the exercise time and vibration may be specified and set by the controller 156. The user 104 may select these options using the remote control (not shown).

Figure 6:
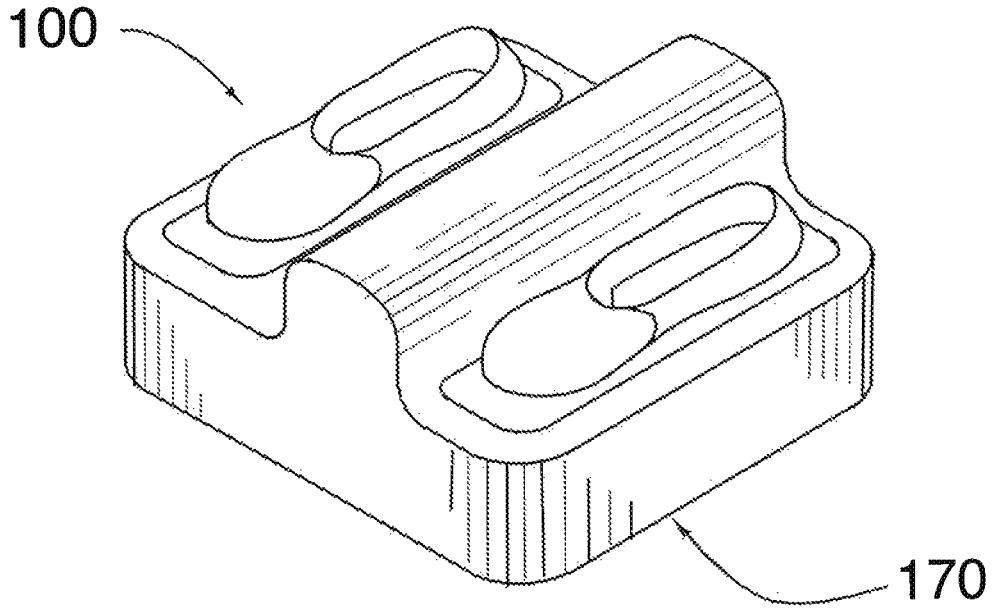
FIG. 6 shows a perspective view of the ankle exerciser system shown in FIG. 1 in accordance with an example embodiment, including a housing.

Reference is now made to FIG. 6, which shows a housing 170 for housing of the exerciser system 100. The housing 170 may enclose and cover the exercise system 100, to enclose the moving parts, and may facilitate safety and easy carrying thereof. The housing 170 may be formed of a rigid material and may include a plastic shell. The housing 170 may also include the base 124 (FIG. 2).

Referring to FIG. 1, the described embodiments are shown to alternate the raising and lowering of the left foot support 106*a* in relation to the right foot support 106*b*. In other example embodiments, it would be appreciated that the left foot support 106*a* and the right foot support 106*b* may be synchronized, to raise or lower simultaneously. For example, rather than being in the configuration shown in FIG. 1, in such example embodiments the left connector 126*a* is configured to be co-axial with the right connector 126*b*, such that a raising or lowering of the lifter plate 114 results in the synchronized motion.

As shown in FIGS. 1 to 3, in some example embodiments each of the left foot support 106*a* and the right foot support 106*b* may be shaped to generally correspond to a sole shape of the shoe members 106*a*, 106*b*, respectively. In other example embodiments, the foot supports 106*a*, 106*b* are shaped in more universal shapes such as generally rectangular or oval.

In some example embodiments, the drive element may be a DC (Direct Current) linear actuator or a double acting cylinder. The linear actuator or double acting cylinder may include an angle type connection to one or both of the foot supports 106*a*, 106*b*, which creates a pulling and pushing action to create the repeating incline and decline motion. In some example embodiments, a length of the right channel 128*b* and the left channel 128*a* may be particularly defined to provide the desired degree of incline and decline. Such example embodiments may provide higher frequencies of operation.

It may be appreciated that some example embodiments of the exerciser system may have wide spread universal medical use for many different possible users.

It may be appreciated that some example embodiments of the exerciser system may simulate physiotherapy exercises which may enhance mobilization in the lower limb and increase blood flow in the leg.

It may be appreciated that some example applications of the exerciser system may be used to address concerns of immobilization, foot drop, deep vein thrombosis, edema, vascular problems and diabetic neuropathy. Example applications may also reduce the high cost for medications, doctors' visits, physiotherapy, etc. Homes, offices, hospitals, nursing homes, rehabilitation centers, schools, airline terminals, aircrafts, and gyms are some other example applications.

Certain adaptations and modifications of the described embodiments can be made. For example, only, and without limitation, the apparatus can be powered by batteries and made portable. Therefore, the above discussed embodiments are considered to be illustrative and not restrictive. Example embodiments described as methods would similarly apply to systems, and vice-versa.

Variations may be made to some example embodiments, which may include combinations and sub-combinations of any of the above. The various embodiments presented above are merely examples and are in no way meant to limit the scope of this disclosure. Variations of the innovations described herein will be apparent to persons of ordinary skill in the art, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

What is claimed is:

1. An exerciser system, comprising:

a first support having a transverse plane;

a first pivot for permitting movement of the first support about a transverse axis;

a connector operatively connected to the first support including at least a portion of the connector extending transversely past the first support;

a drive element in the form of a motor, the drive element being operatively coupled to the at least a portion of the connector at a part of the connector away from the transverse axis for moving of the connector to pivot the first support about the first pivot;

a body member slideably connected to the part of the connector, wherein the drive element is operatively coupled to the body member;

a worm gear screw coupled to the drive element;

a first arm having a first proximal part and a first distal part, wherein the first proximal part is pivotable and operatively coupled to the body member; and a second arm having a second proximal part and a second distal part, wherein the second proximal part is pivotable and operatively coupled to the body member, a first gear at the first proximal part;

a second gear at the second proximal part interlocking with the first gear for facilitating equal and opposite pivoting of the first arm and the second arm;

wherein the drive element is operatively coupled to at least the first distal part or the second distal part for controlling movement of at least the first arm or the second arm.

2. The exerciser system as claimed in claim 1, further comprising:

a first carriage pivotally connected to the first distal part;

a second carriage pivotally connected to the second distal part; and wherein the worm gear screw is operatively coupled to the first carriage and the second carriage for longitudinally moving the first carriage and the second carriage in opposite directions.

3. The exerciser system as claimed in claim 1, further comprising:

a mechanism for releasably attaching a shoe member to the first support.

4. The exerciser system as claimed in claim 1, further comprising a vibrator operatively coupled to vibrate at the first support.

5. The exerciser system as claimed in claim 1, further comprising:

a second support; and a second pivot for permitting movement of the second support about the transverse axis, wherein the drive element is operatively coupled to the second support to pivot the second support about the second pivot.

6. The exerciser system as claimed in claim 5, wherein the first support is controllable to pivot in an axial rotation and the second support is controllable to pivot in an opposite axial rotation.

7. The exerciser system as claimed in claim 5, wherein the first support and the second support are controllable to pivot in a same axial rotation.

* * * * *